US008624689B2

(12) United States Patent
Hsieh et al.

(10) Patent No.: US 8,624,689 B2
(45) Date of Patent: Jan. 7, 2014

(54) POWER LINE FILTER

(75) Inventors: Shin-Chih Hsieh, Taoyuan Hsien (TW); Po-Jen Tsai, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 519 days.

(21) Appl. No.: 12/899,150

(22) Filed: Oct. 6, 2010

(65) Prior Publication Data

US 2011/0080231 A1 Apr. 7, 2011

(30) Foreign Application Priority Data

Oct. 6, 2009 (TW) ..... 98133794 A

(51) Int. Cl.
*H03H 7/01* (2006.01)
*H01R 13/66* (2006.01)
*H02J 3/01* (2006.01)

(52) U.S. Cl.
USPC ..... 333/185; 439/620.21; 363/39

(58) Field of Classification Search
USPC ..... 439/620.21; 320/111; 337/194–199, 337/257; 363/146, 39–48; 333/185
See application file for complete search history.

(56) References Cited

U.S. PATENT DOCUMENTS 5,206,779 A * 4/1993 Sato et al. ..... 361/111
5,292,257 A * 3/1994 Milan ..... 439/214
5,340,944 A * 8/1994 Wang ..... 174/350
5,475,347 A * 12/1995 Kwak ..... 333/185
5,760,591 A * 6/1998 Matsuda et al. ..... 324/524
7,259,975 B2 * 8/2007 Holme Pedersen et al. .. 363/146

OTHER PUBLICATIONS

S. Wang, F.C. Lee, D.Y. Chen, W. G. Odendaal, Effects of Parasitic Parameters on EMI Filter Performance, Power Electronics Specialist Conference, PESC '03, Jun. 15-19, 2003, pp. 73-78.*

* cited by examiner

*Primary Examiner* — Benny Lee
*Assistant Examiner* — Rakesh Patel
(74) *Attorney, Agent, or Firm* — Muncy, Geissler, Olds & Lowe, PLLC

(57) ABSTRACT

A power line filter including a socket, a housing, a plurality of filter elements and a ground inductor is disclosed. The socket includes at least one power pin and a ground pin. The housing is assembled with the socket, and includes a first receptacle and a second receptacle. The opening direction of the first receptacle is opposite to the opening direction of the second receptacle. The plurality of filter elements is disposed in the first receptacle. At least one of the filter elements is electrically connected to the power pin. The ground inductor is disposed in the second receptacle and electrically connected to the ground pin.

22 Claims, 4 Drawing Sheets

POWER LINE FILTER

CROSS REFERENCE TO RELATED APPLICATIONS

This Non-provisional application claims priority under 35 U.S.C. §119(a) on Patent Application No. 098133794 filed in Taiwan, Republic of China on Oct. 6, 2009 the entire contents of which are hereby incorporated by reference.

BACKGROUND OF THE INVENTION

1. Field of Invention

The present invention relates to a power line filter, and, in particular, to a size-reduced, material-saving, labor-saving and high-yield power line filter.

2. Related Art

The basic structure of a conventional power line filter is composed of a socket and a housing disposed at one side of the socket. The electronic elements such as an X capacitor, a Y capacitor, a filter inductor and a ground inductor are disposed in the receptacle of the housing. However, because the filter inductor and the ground inductor are both disposed in the receptacle of the housing, the distance between them is quite short. Furthermore, the ground inductor is generally wrapped by an insulating tape only. Thus, the filter inductor, the ground inductor or other inductor elements are vulnerable to be interfered by each other so as to influence the filtering results. Additionally, the insulating tape wrapping the outside of the ground inductor is easily detached and cracked, and its insulating efficacy is quite limited as well. It results in generating sparks due to a high voltage difference, which is occasionally induced between the filter inductor and the ground inductor by a significant variation of magnetic fields at the moment of being powered on or off. This severely endangers the safety of use.

SUMMARY OF THE INVENTION

The present invention is to provide a power line filter, especially a size-reduced, material-saving, labor-saving and high-yield power line filter.

To achieve the above, the power line filter includes a socket, a housing, a plurality of filter elements and a ground inductor. The socket includes at least one power pin and a ground pin. The housing is assembled with the socket, and has a first receptacle and a second receptacle. The opening direction of the first receptacle is opposite to the opening direction of the second receptacle. The plurality of filter elements is disposed in the first receptacle, and at least one of the filter elements is electrically connected to the power pin. The ground inductor is disposed in the second receptacle and electrically connected to the ground pin.

The power line filter further includes a connecting element disposed between the socket and the housing to connect the ground pin to the ground inductor. The connecting element includes a protruding portion extending out from the opening of the second receptacle to connect the ground inductor. Preferably, the connecting element includes a groove to engage with the ground pin.

The housing further includes a division plate and a side plate. The division plate divides the housing into the first receptacle and the second receptacle. A first bottom plate used as a bottom portion of the first receptacle is extended from one of two corresponding ends of the division plate, and a second bottom plate used as a bottom portion of the second receptacle is extended from the other one of the two corresponding ends of the division plate. Preferably, the second bottom plate has a through hole to hold the ground inductor. The side plate is disposed between the first receptacle and the socket to insulate the ground pin from the plurality of filter elements. Preferably, the housing, the division plate and the side plate are formed as one piece with an insulating material.

The filter elements include an X capacitor, two Y capacitors and a filter inductor. The filter inductor is preferably disposed at the bottom of the first receptacle, and the X capacitor is disposed above the filter inductor. The two Y capacitors are disposed at one side of the X capacitor and the filter inductor, and located at one side in the first receptacle opposite to the socket. Preferably, the X capacitor and the filter inductor are electrically connected to the power pin.

The power line filter further includes at least one power terminal and a ground terminal. The at least one power terminal extends out from the housing. The filter inductor and the two Y capacitors are electrically connected to the power terminal. The ground terminal has two end portions extending out from the opening of the first receptacle and the second opening of the second receptacle, respectively. Preferably, one of the two end portions of the ground terminal is connected to the ground inductor, and the other one of the two end portions is connected to the Y capacitor. The housing has a groove, and the ground terminal is engaged within the groove. Preferably, the at least one power terminal and the ground terminal are disposed at one side of the housing opposite to the socket.

The power line filter further includes an insulating cover disposed on the opening of the first receptacle to cover the filter elements. The power line filter further includes a metal case and a first locking element. The metal case is mounted on the surfaces of the socket and the housing. The first locking element is used to assemble the metal case with the socket. The power line filter further includes a second locking element used to assemble the socket with the housing. Preferably, the power pins are a line wire pin and a neutral wire pin, and the power terminals are a line wire terminal and a neutral wire terminal.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
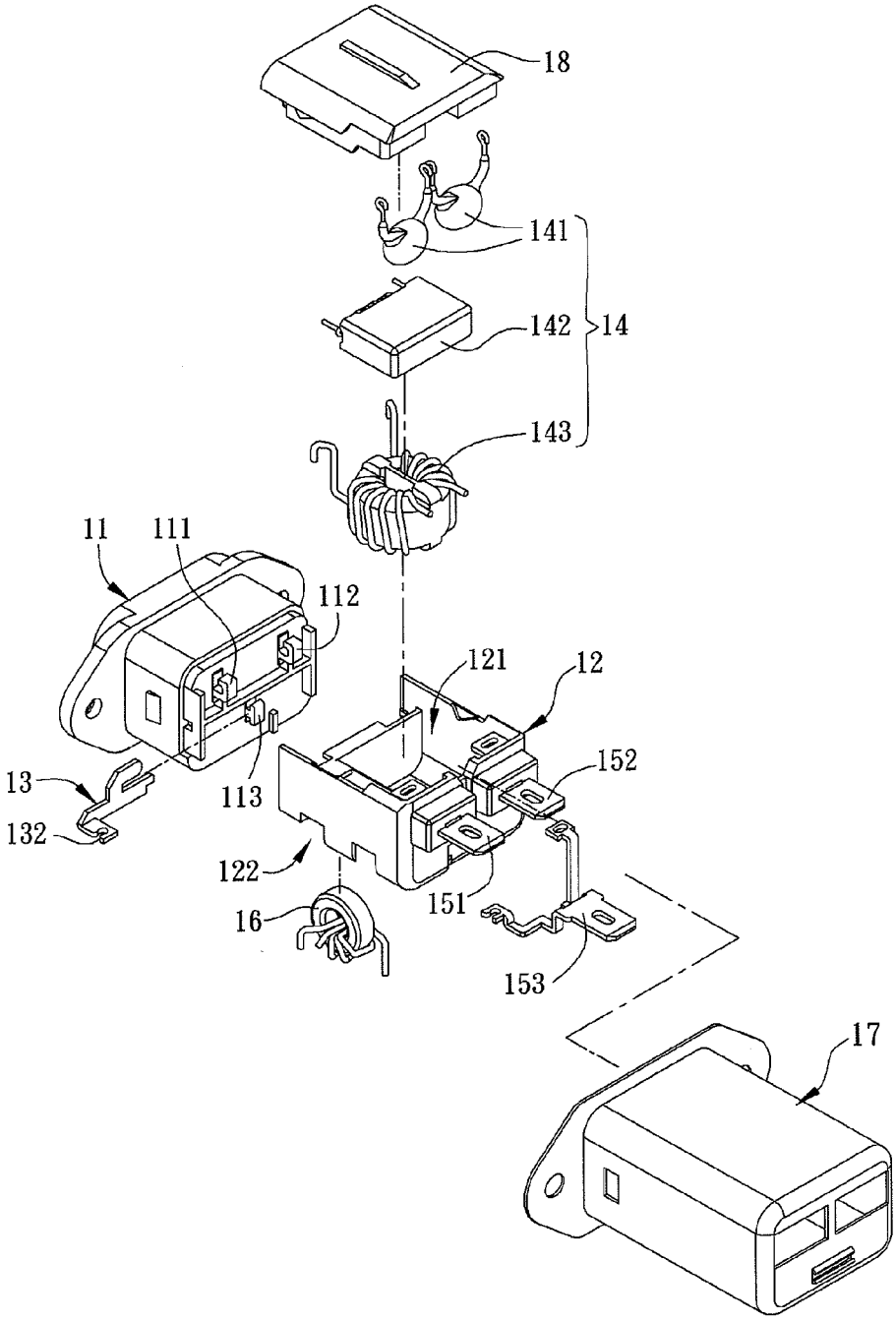
FIG. 1 is an exploded view of a power line filter in accordance with a preferred embodiment of the present invention.

As shown in FIG. 1, a power line filter in accordance with a preferred embodiment of the present invention includes a socket 11, a housing 12, a plurality of filter elements 14 and a ground inductor 16. The socket 11 includes a first power pin 111, a second power pin 112 and a ground pin 113. The housing 12 is assembled with the socket 11, and has a first receptacle 121 and a second receptacle 122. The opening direction of the first receptacle 121 is opposite to the opening direction of the second receptacle 122. In more detailed, the opening of the first receptacle 121 is upward, but the opening of the second receptacle 122 is downward. The plurality of filter elements 14 is disposed in the first receptacle 121, and at least one of the filter elements 14 is electrically connected to the first power pin 111 and the second power pin 112. The ground inductor 16 is disposed in the second receptacle 122 and electrically connected to the ground pin 113.

Figure 2A:
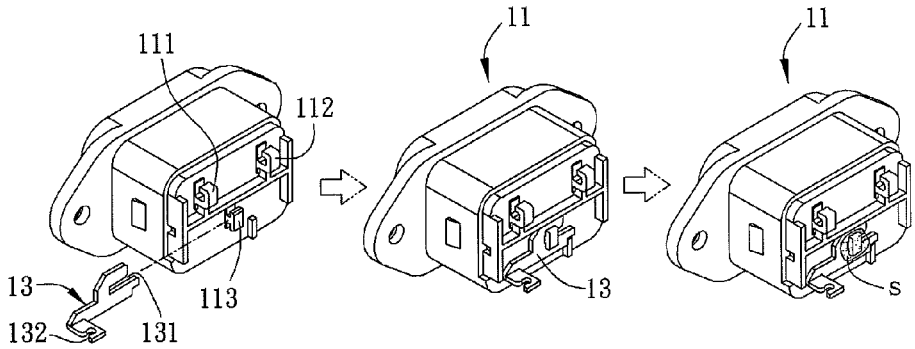
FIGS. 2A to 2F are schematic figures showing the assembling steps of the power line filter shown in FIG. 1.

The power line filter further includes a connecting element 13 disposed between the socket 11 and the housing 12 to connect the ground pin 113 to the ground inductor 16. As shown in FIG. 2A, the connecting element 13 includes a protruding portion 132 extending out from the opening of the second receptacle 122 to connect the ground inductor 16. Preferably, the connecting element 13 has a groove 131 to engage with the ground pin 113, and then the connecting element 13 and the ground pin 113 are fixed together with a solder s.

Figure 2B:
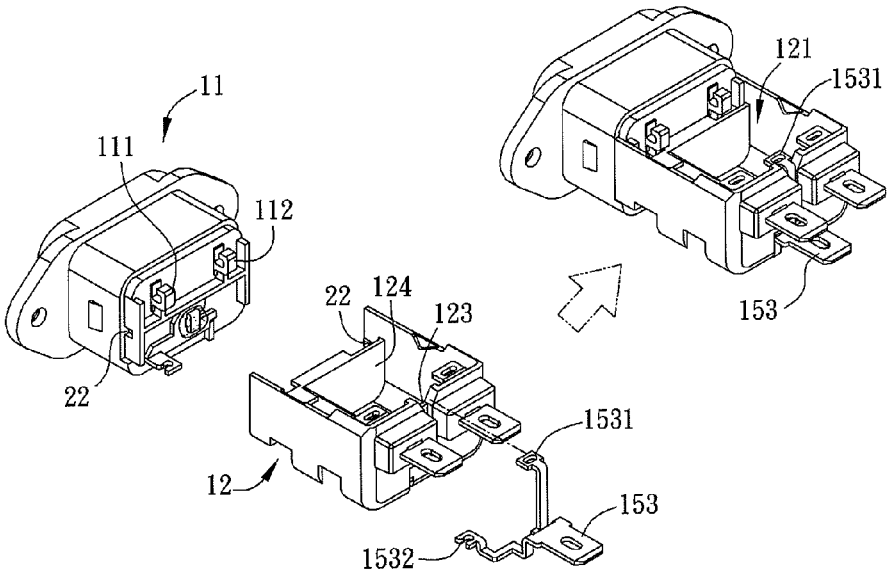
Figure 2C:
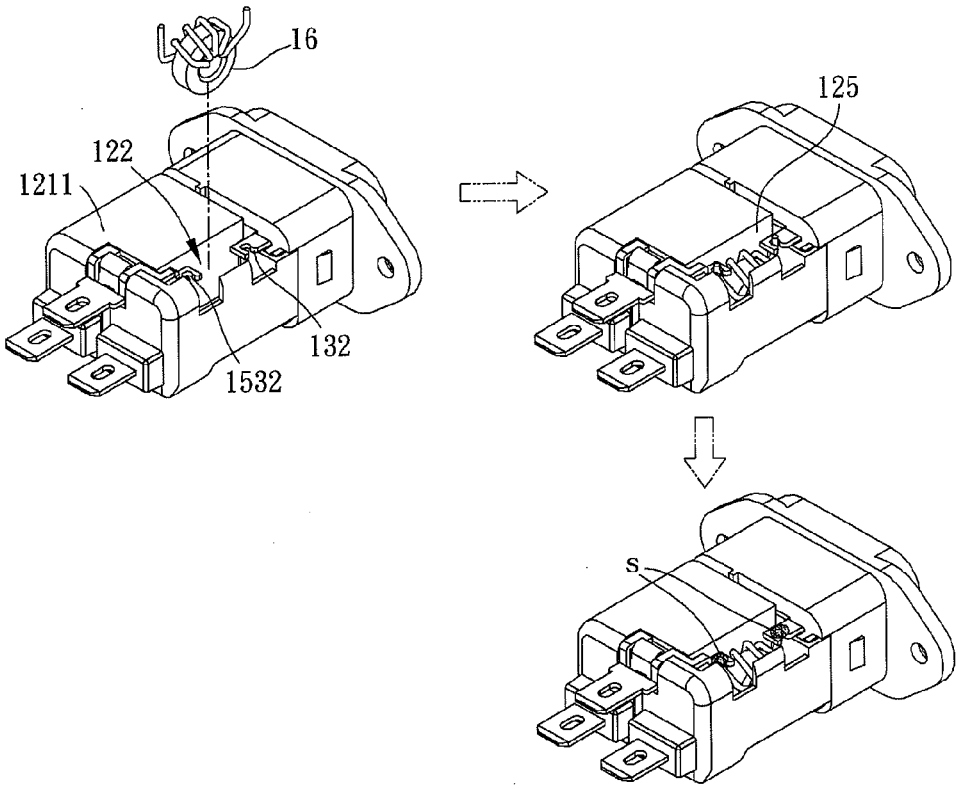
Figure 2D:
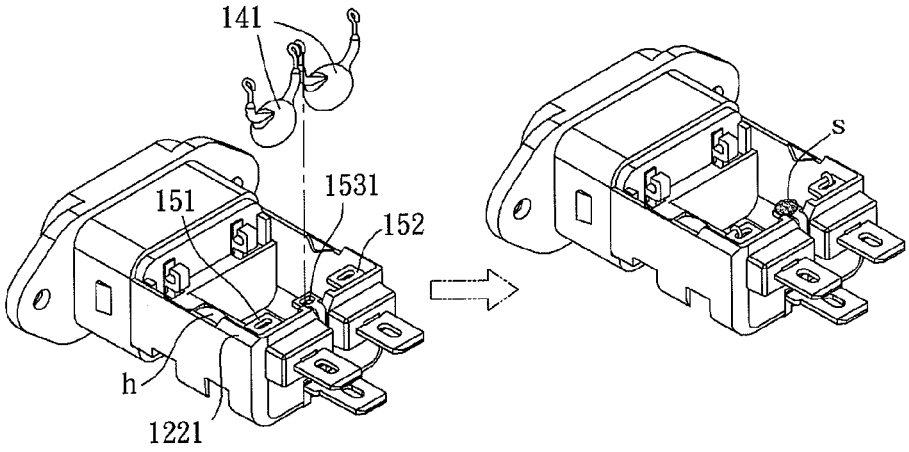

As shown in FIG. 2C, the housing includes a division plate 125, and the division plate 125 divides the housing into the first receptacle 121 and the second receptacle 122. As shown in FIG. 2D, a first bottom plate 1211 used as a bottom portion of the first receptacle 121 is extended from one of two corresponding ends of the division plate 125, and a second bottom plate 1221 used as a bottom portion of the second receptacle 122 is extended from the other one of the two corresponding ends of the division plate 125. Preferably, the second bottom plate 1221 has a through hole h to hold the ground inductor 16. As shown in FIG. 2B, the housing also includes a side plate 124 disposed between the first receptacle 121 and the socket 11 to insulate the ground pin 113 from the plurality of filter elements 14. Preferably, the housing 12, the division plate 125 and the side plate 124 are formed as one piece with an insulating material.

Figure 2E:
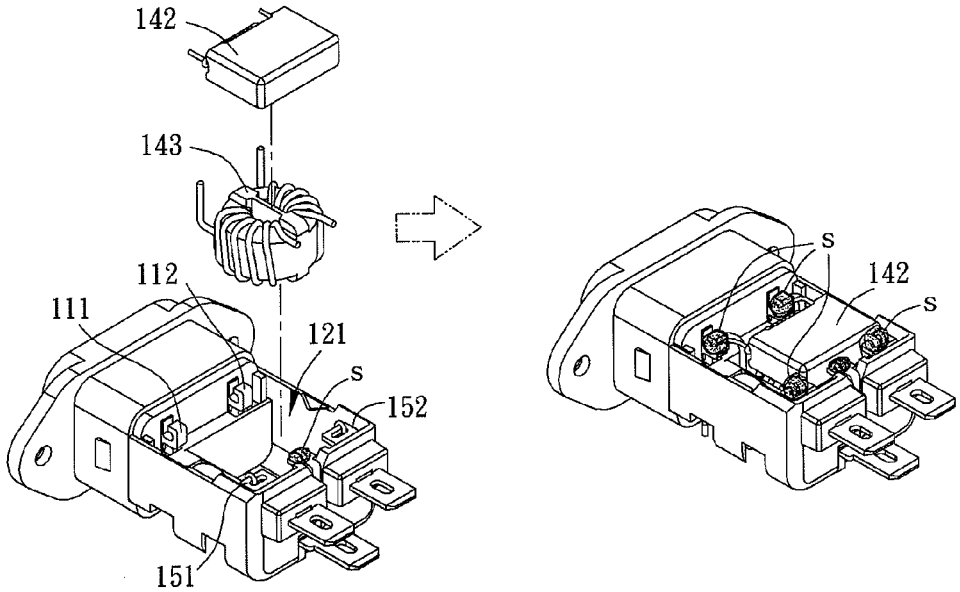

As shown in FIGS. 2D and 2E, the plurality of filter elements includes an X capacitor 142, two Y capacitors 141 and a filter inductor 143. The filter inductor 143 is preferably disposed at the bottom of the first receptacle 121, and the X capacitor 142 is disposed above the filter inductor 143. The two Y capacitors 141 are disposed at one side of the X capacitor 142 and the filter inductor 143, and located at one side in the first receptacle 121 opposite to the socket 11. Preferably, the X capacitor 142 and the filter inductor 143 are electrically connected to the first power pin 111 and the second power pin 112.

The power line filter further comprises a first power terminal 151, a second power terminal 152 and a ground terminal 153. As shown in FIGS. 2B and 2C, the first power terminal 151 and the second power terminal 152 extend out from the housing 12. The filter inductor 143 and the two Y capacitors 141 are electrically connected to the first power terminal 151 and the second power terminal 152. The ground terminal 153 is disposed outside the housing 12. One end of the ground inductor 16 is connected to the ground terminal 153, and the other end of the ground inductor 16 is electrically connected to the ground pin 113 by the protruding portion 132 of the connecting element 13. The ground terminal 153 has two end portions 1531 and 1532 extending out from the opening of the first receptacle 121 and the second opening of the second receptacle 122, respectively. Preferably, the end portion 1532 of the two end portions of the ground terminal 153 is connected to the ground inductor 16, and the other end portion 1531 of the two end portions is connected to the two Y capacitor 141. The housing 12 has a groove 123, and the ground terminal 153 is engaged within the groove 123. Preferably, the first power terminal 151, the second power terminal 152 and the ground terminal 153 are disposed at one side of the housing 12 opposite to the socket 11.

Figure 2F:
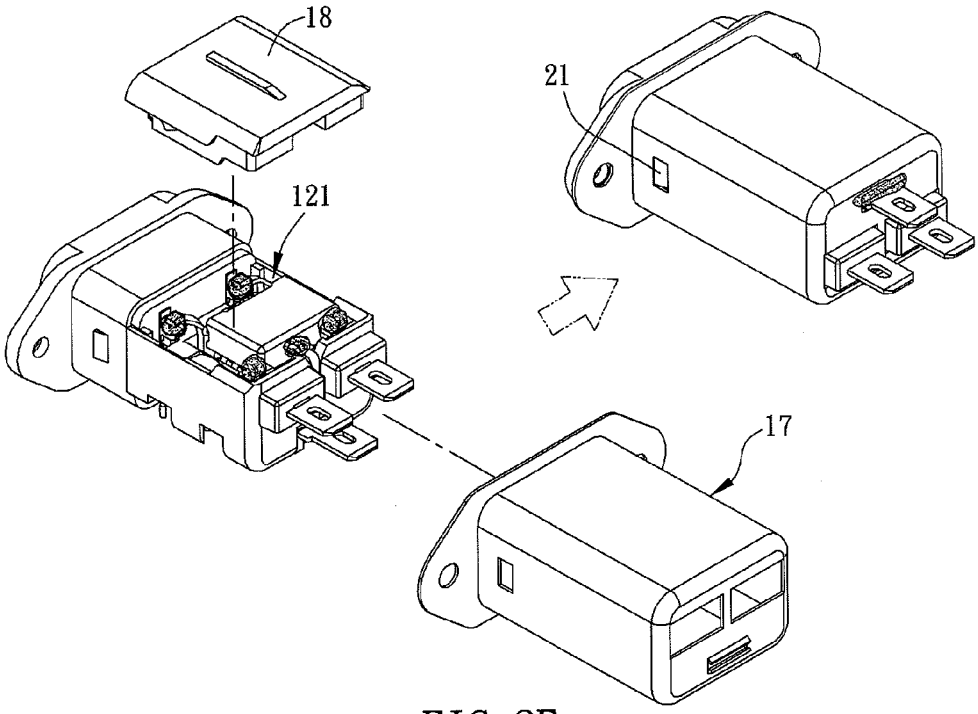

As shown in FIG. 2F, the power line filter further includes an insulating cover 18 disposed on the opening of the first receptacle 121 to cover the plurality of filter elements 14. The power line filter further includes a metal case 17 and a first locking element 21. The metal case 17 is mounted on the surfaces of the socket 11 and the housing 12. The first locking element 21 is used to assemble the metal case 17 with the socket 11. As shown in FIG. 2B, the power line filter further includes a second locking element 22 used to assemble the socket 11 with the housing 12. The plurality of filter elements 14, the ground inductor 16, the first power terminal 151, the second power terminal 152, the ground terminal 153, the first power pin 111, the second power pin 112 and the ground pin 113 are fixed together with the solders s. The first power pin 111 and the second power pin 112 are preferably a line wire pin and a neutral wire pin. The first power terminal 151 and the second power terminal 152 are preferably a line wire terminal and a neutral wire terminal.

In summary, the power line filter of the present invention contains a plurality of filter elements and a ground inductor in two receptacles of a housing, respectively, among others the opening directions of the two receptacles are opposite with respect to each other. Thus, the ground inductor can be disposed upright at one side of a filter inductor so that it can shorten the length of the power line filter by improving the interior design and the element arrangement. Otherwise, taking advantage of the double-receptacle design, the present invention can omit the material and the process that use the insulating tape, and avoid the safety issue resulted from the detachment or the crack of the insulating tape during the manufacturing or executing processes thereof.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A power line filter, comprising:

a socket comprising at least one power pin and a ground pin;

a housing assembled with the socket and comprising a first receptacle and a second receptacle, wherein the opening direction of the first receptacle is opposite to the opening direction of the second receptacle;

a plurality of filter elements disposed in the first receptacle, wherein at least one of the plurality of filter elements is electrically connected to the at least one power pin, wherein the plurality of filter elements comprise an X capacitor, two Y capacitors and a filter inductor;

a ground inductor disposed in the second receptacle and electrically connected to the ground pin; and a ground terminal disposed outside the housing, wherein two ends of the ground inductor are electrically connected to the ground terminal and the ground pin, respectively, wherein the housing comprises a groove, and the ground terminal is engaged within the groove.

2. The power line filter of claim 1, further comprising:

a connecting element disposed between the socket and the housing to c he ground pin to the ground inductor.

3. The power line filter of claim 2, wherein the connecting element comprises a protruding portion extending out from an opening of the second receptacle to connect the ground inductor.

4. The power line filter of claim 3, wherein the connecting element comprises a connecting groove to engage with the ground pin.

5. The power line filter of claim 1, wherein the housing further comprises a division plate to divide the housing into the first receptacle and the second receptacle.

6. The power line filter of claim 5, wherein a first bottom plate used as a bottom portion of the first receptacle is extended from one of two corresponding ends of the division plate, and a second bottom plate used as a bottom portion of the second receptacle is extended from the other one of the two corresponding ends of the division plate.

7. The power line filter of claim 6, wherein the second bottom plate comprises a through hole to hold the ground inductor.

8. The power line filter of claim 5, wherein the housing further comprises a side plate disposed between the first receptacle and the socket to insulate the ground pin from the plurality of filter elements.

9. The power line filter of claim 8, wherein the housing, the division plate and the side plate are formed as one piece with an insulating material.

10. The power line filter of claim 1, wherein the at least one power pin comprises a line wire pin and a neutral wire pin.

11. The power line filter of claim 1, wherein the filter inductor is disposed at the bottom of the first receptacle, and the X capacitor is disposed above the filter inductor.

12. The power line filter of claim 11, wherein the two Y capacitors are disposed at one side of the X capacitor and the filter inductor, and located at one side in the first receptacle opposite to the socket.

13. The power line filter of claim 1, wherein the X capacitor and the filter inductor are electrically connected to the at least one power pin.

14. The power line filter of claim 1, further comprising:

at least one power terminal extending out from the housing, wherein the filter inductor and the two Y capacitors are electrically connected to the at least one power terminal.

15. The power line filter of claim 14, wherein the at least one power terminal comprises a line wire terminal and a neutral wire terminal.

16. The power line filter of claim 1, wherein the ground terminal comprises two end portions extending out from an opening of the first receptacle and an opening of the second receptacle, respectively.

17. The power line filter of claim 16, wherein one of the two end portions of the ground terminal is connected to the ground inductor and the other one of the two end, portions is connected to both of the two Y capacitors.

18. The power line filter of claim 1, further comprising:

a second locking element for assembling the socket with the housing.

19. The power line filter of claim 14, wherein the at least one power terminal and the ground terminal are disposed at one side of the housing opposite to the socket.

20. The power line filter of claim 1, further comprising:

an insulating cover disposed on the opening of the first receptacle to cover the plurality of filter elements.

21. The power line filter of claim 1, further comprising:

a metal case mounted on the surfaces of the socket and the housing.

22. The power line filter of claim 21, further comprising:

a first locking element for assembling the metal case with the socket.

* * * * *